United States Patent [19]

Jore

[11] Patent Number: 4,462,960

[45] Date of Patent: Jul. 31, 1984

[54] ZINC ANODE ALLOY FOR SACRIFICIAL ANODES

[75] Inventor: Torleif N. Jore, Slemmestad, Norway

[73] Assignee: Norzink A/S, Odda, Norway

[21] Appl. No.: 453,152

[22] Filed: Dec. 27, 1982

[30] Foreign Application Priority Data

Dec. 28, 1981 [NO] Norway ..... 814438

[51] Int. Cl.[3] ..... C22C 18/00

[52] U.S. Cl. ..... 420/519; 420/523

[58] Field of Search ..... 420/519, 523; 204/147, 204/248, 293

[56] References Cited

U.S. PATENT DOCUMENTS 4,166,153 8/1979 Fercke ..... 420/519

*Primary Examiner*—L. Dewayne Rutledge
*Assistant Examiner*—Robert L. McDowell
*Attorney, Agent, or Firm*—Cushman, Darby & Cushman

[57] ABSTRACT

A zinc anode alloy for sacrificial anodes, for preventing intercrystalline corrosion, comprises 0.10–0.50% by weight Al, 0.025–1.15% by weight Cd, and the remainder zinc and impurities caused by the production method, wherein the alloy also contains 0.01–1.0% magnesium.

3 Claims, No Drawings

ZINC ANODE ALLOY FOR SACRIFICIAL ANODES

Operating experience with sacrificial anodes of zinc in use on hot, buried oil pipelines in the North Sea has shown that the anodes are broken down by intercrystalline corrosion. These anodes, which are in conformity with US MIL. SPEC. A-18001 H and contain 0.10–0.50% by weight aluminium, 0.025–0.15% by weight cadmium and the rest zinc, with small amounts of iron, copper, lead and silicon impurities, simply crumble away.

Experimental test data also corroborates that intercrystalline corrosion occurs in these anode alloys when they are subjected to heat.

This phenomenon is also well known from earlier impure pressure-diecast zinc alloys, and it is claimed that this is caused by the aluminium content. In the anode alloys tested, enrichment of aluminium has been shown to be present at the grain boundaries. It is alleged that an Al content of 0.03% will cause this.

However, in the case of pressure-diecast alloys containing about 4% aluminium, it has been shown that the cause of the intercrystalline corrosion is an excessive content of Sn, Pb or Cd. If this content is held at a low enough level, there is no problem of intercrystalline corrosion. The maximum levels of Pb and Cd are set at 0.003% each.

What actually takes place when intercrystalline corrosion occurs in pressure-diecast alloys has not been discussed much in the literature, except to say that it occurs when the content of Sn, Pb or Cd exceeds a certain value.

It is possibly correct, as stated in the literature, that aluminium penetrates into the grain boundaries, is enriched there and thereby breaks the bonds, but that this reaction occurs only when the Cd content (or Pb,Sn) exceeds a certain value. However, it has also been claimed that aluminium in an amount of 0.03% will cause intercrystalline corrosion. This seems somewhat strange, since the aluminium content in the pressure-diecast alloys mentioned above is 4%. It is possible that the explanation resides in the difference in crystal structure. Pressure-diecast products will have a finer crystal structure than the anodes owing to the casting method and cooling conditions.

Adding Mg to pressure-diecast alloys has proved to be beneficial and to provide an additional safeguard against intercrystalline corrosion. In specifications the content of this additive is set at 0.04–0.06%, because a higher content produces products which are fragile when warm and which thus might crack upon being removed from the dies.

The object of the present invention is to provide a zinc anode alloy for sacrificial anodes whereby decomposition owing to intercrystalline corrosion is prevented.

It is not previously known to add magnesium to such anode alloys.

The invention thus relates to a zince anode alloy for sacrificial anodes comprising 0.10–0.50% by weight Al
0.025–0.15% by weight Cd
remainder zinc wherein the alloy is characterized by also containing 0.01–1.0% Mg.

The alloy can also contain smaller amounts of the following other metals: Fe, max. 0.005% by weight; Cu, max. 0.005% by weight; Pb, max. 0.006% by weight; and Si, max. 0.125% by weight.

By utilizing zinc anodes of the composition according to the invention for cathodic protection of hot, buried oil pipelines, intercrystalline corrosion can be prevented.

Having described my invention, I claim:

1. A zinc anode alloy for sacrificial anodes consisting essentially of 0.01–1.0% by weight magnesium
0.10–0.50% by weight of aluminium
0.025–0.15% by weight of cadmium
and the remainder zinc and impurities caused by the production method.

2. A zinc anode alloy as in claim 1 consisting essentially of iron up to 0.005 weight %, copper up to 0.005 weight %, lead up to 0.006 weight %, Si up to 0.125 weight %, aluminum 0.10–0.50 weight %, cadmium 0.025–0.15 weight %, magnesium 0.01–1.0 weight %, balance zinc with usual impurities.

3. A zinc anode alloy for sacrificial anodes consisting of 0.10–0.50 weight % aluminum, 0.025–0.15 weight % cadmium, 0.01–1.0 weight % magnesium, balance zinc with usual impurities.

* * * * *